US007234288B2

(12) United States Patent
Lebedevski et al.

(10) Patent No.: US 7,234,288 B2
(45) Date of Patent: Jun. 26, 2007

(54) FOLDER SHEETS WITH REINFORCED HOLES, METHOD AND APPARATUS OF MAKING SAME

(75) Inventors: Ricardo Lebedevski, Buenos Aires (AR); Jose Ramon Gallo, La Rioja (AR)

(73) Assignee: Angel Estrada & Cia, Buenos Aires (AR)

( * ) Notice: Subject to any disclaimer, the term of this patent is extended or adjusted under 35 U.S.C. 154(b) by 0 days.

(21) Appl. No.: 10/940,412

(22) Filed: Sep. 13, 2004

(65) Prior Publication Data

US 2005/0086912 A1 Apr. 28, 2005

Related U.S. Application Data

(63) Continuation-in-part of application No. 09/950,929, filed on Sep. 12, 2001, now abandoned.

(30) Foreign Application Priority Data

Mar. 12, 2001 (AR) ..... M010101153

(51) Int. Cl.
*B65B 63/00* (2006.01)
*B65B 53/00* (2006.01)
*B05D 5/00* (2006.01)

(52) U.S. Cl. ..... 53/428; 53/442; 53/435; 53/447; 53/449; 281/38; 402/79; 427/285; 428/137; 428/192

(58) Field of Classification Search ..... 53/442, 53/557, 435, 428, 520, 111 R, 447, 540, 449, 53/171, 174; 281/38; 402/79; 427/285; 428/137, 192; 493/229, 237, 194, 199
See application file for complete search history.

(56) References Cited

U.S. PATENT DOCUMENTS 3,232,808 A * 2/1966 Dries et al. ..... 156/253
3,895,476 A * 7/1975 Burns, III ..... 53/442
4,354,890 A * 10/1982 Maffey ..... 281/21.1
4,528,056 A * 7/1985 Hunt et al. ..... 427/285
4,910,066 A * 3/1990 Foisie ..... 427/285

(Continued)

FOREIGN PATENT DOCUMENTS

WO WO 03/050199 A1 * 6/2003

*Primary Examiner*—Stephen F. Gerrity
(74) *Attorney, Agent, or Firm*—Hughes Hubbard & Reed LLP

(57) ABSTRACT

A method of manufacturing folder sheets with reinforce holes, which comprises unwinding a spindled paper band; printing predetermined graphics on the paper band; causing the paper band to go through corona treatment; applying a reinforcement strip of thermoplastic material to selected areas of the paper band; cutting the printed and partially reinforced paper band in a direction substantially perpendicular to one edge of the paper band in such a fashion as to form a plurality of paper strips each having an elongated reinforced edge area; layering and counting the paper strips until they reach a predetermined number; punching the paper strips in the reinforced edge area in accordance with a predetermined pattern; cutting the punched paper strips in a direction substantially perpendicular to the direction of the first cutting to form a plurality of folder sheets; counting and piling the folder sheets to form a block until they reach a predetermined number; and packaging and boxing the folder sheet blocks.

20 Claims, 4 Drawing Sheets

U.S. PATENT DOCUMENTS 5,304,275 A * 4/1994 Lowe ..... 156/270
5,518,799 A * 5/1996 Finestone et al. ..... 428/137
5,842,722 A * 12/1998 Carlson ..... 283/107
5,878,554 A * 3/1999 Loree et al. ..... 53/540
6,040,018 A * 3/2000 Lamers ..... 427/285
6,146,728 A * 11/2000 Bay ..... 402/79
6,261,658 B1 * 7/2001 Schmidt ..... 428/192
6,632,042 B1 * 10/2003 Liener Chin et al. ..... 402/79

* cited by examiner

FIG. 1
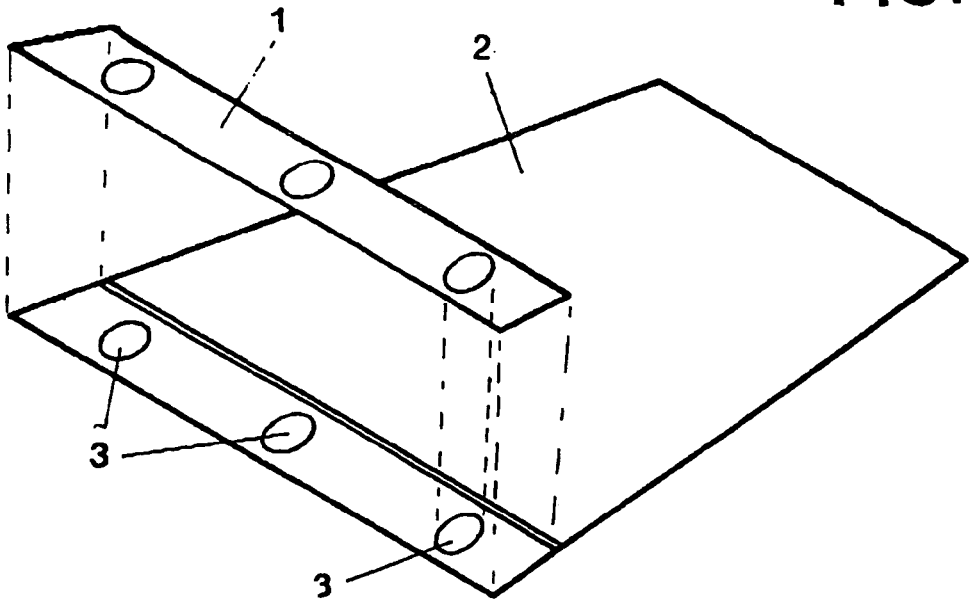
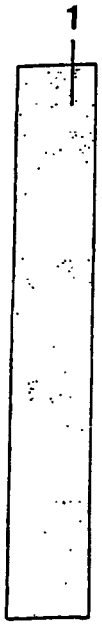
FIG. 2
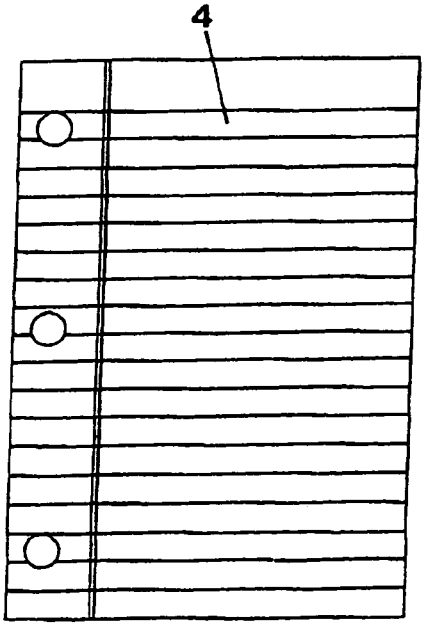
FIG. 3
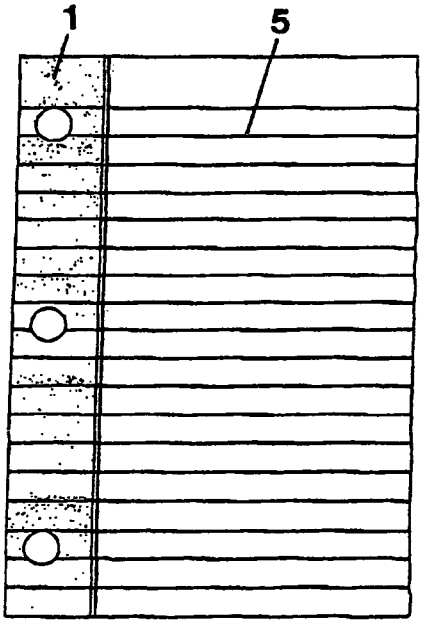
FIG.4

FOLDER SHEETS WITH REINFORCED HOLES, METHOD AND APPARATUS OF MAKING SAME

CROSS-REFERENCE TO RELATED APPLICATIONS

This application is a continuation-in-part of prior application Ser. No. 09/950,929, filed on Sep. 12, 2001, (now abandoned) which claims priority based on Argentine Application No. M010101153. A certified copy of the Argentine application has been filed in application Ser. No. 09/950,929.

BACKGROUND OF THE INVENTION

1. Field of the Invention

This invention relates to stationery articles in general. More particularly, this invention relates to a complete reinforcement device to be incorporated to punched folder sheets for school, student and business uses, a method of making or manufacturing punched folder sheets with such reinforcement device, and an apparatus used to manufacture such folder sheets.

2. Description of the Related Art

It is quite common to see folder or filler sheets of different sizes, with or without lines, of the various qualities of paper on the market place these days, which are commonly used for manual or typed writing or drawing. These sheets can be found at stationery shops, either as loose units, or in packages of different quantities, or even bound so as to be preserved in good condition for use at any time. These sheets may then be used for performing any homework, writing exercises, maps, drawings or paintings made by schoolchildren or students of secondary or tertiary level, and also for office worksheets made by hand or machine. All such work is then saved into folders or covers specially prepared for such use. These folders or covers are equipped with fastening devices such as broken rings with fast opening and closing mechanisms, pass-through screws, metal strips, which pass through circular, oval or square holes that are provided on the sheets, either lengthwise or crosswise, and then bent against a metal channel to be secured by sliding pieces or other similar devices.

It is common to observe a marked deterioration of the punched holes due to careless manipulation, especially by schoolchildren and students of all ages and levels, which usually results in the need to make a second hole close to the previous one. This of course changes the alignment of the sheets. In an effort to solve this problem, a variety of sticky cardboard washers to be applied to the broken or damaged punched holes were proposed and/or marketed. A later improvement was the use of washers made of a cloth-type material.

BRIEF SUMMARY OF THE INVENTION

Therefore, one object of this invention is to provide a simple and practical reinforcement device, which increases paper resistance around the punched areas of the folder sheets and facilitates their orderly presentation or filing into folders or other elements so as to reduce their deterioration by permanent manipulation.

This invention is thus aimed at providing a device of attractive and economic construction which ensures an appropriate conservation of the sheets in their folders as the punched holes made in the original paper or cardboard sheets remain in good condition for a relatively long period of time in spite of mistreatment or the frequent placement and removal of rings or other fastening means provided with the folders.

It is obvious that such a really simple reinforcement device ensures at all times an appropriate presentation of any worksheets, annotations, homework, drawings, tables, etc., of the type that usually requires the use of loose sheets with side or top punches to permit their conservation in folders, loose covers, filing devices and the like.

Another object of this invention is to provide a new and definitive solution to this problem, which could be implemented in an easy, economic and attractive form. In addition, this invention offers an optimum constructive arrangement. It basically consists of a reinforcement strip to be incorporated during the manufacturing process of the sheet, regardless of its quality or size.

This invention uses conventional paper sheets, such as the so-called "repuestos" or spare sheets, to which a reinforcement strip consisting of a thin thermoplastic material film is applied.

The film covers the punched hole rim. The strip may be applied continuously or by sections, and it is intimately incorporated to the fibers of the basic paper sheets.

Yet another object of the invention is to provide a method and apparatus of making or manufacturing folder sheets with reinforce holes. During the manufacturing process, a reinforcement strip is added to the line of continuous production of the aforementioned folder sheets. This object is achieved in a method which comprises unwinding a spindled paper band; printing predetermined graphics on the paper band; causing the paper band to go through corona treatment; applying a reinforcement strip of thermoplastic material to selected areas of the paper band; cutting the printed and partially reinforced paper band in a direction substantially perpendicular to one edge of the paper band in such a fashion as to form a plurality of paper strips each having an elongated reinforced edge area; layering and counting the paper strips until they reach a predetermined number; punching the paper strips in the reinforced edge area in accordance with a predetermined pattern; cutting the punched paper strips in a direction substantially perpendicular to the direction of the first cutting to form a plurality of folder sheets; counting and piling the folder sheets to form a block until they reach a predetermined number; and packaging and boxing the folder sheet blocks.

The apparatus that is added to the conventional production machine has a gravimetric and pneumatic feeding system with means of measuring and visualizing the extrusion volume. The feeding system feeds a thermoplastic material, for example, polyethylene in granules, to a lineal extrusion apparatus, which in turn provides the melted thermoplastic material to an applicator with multiple exits. A high tension and high frequency generator is included to provide corona treatment or corona discharge, which conditions the surface of a paper band where the thermoplastic material will be applied, in connection with a calender system with two rollers or cylinders, one for application of the thermoplastic material to the paper band and the other for cooling off the thermoplastic material after it is applied to the paper band.

Other aspects and advantages of this invention will be apparent from reading the detailed description that follows.

BRIEF DESCRIPTION OF THE DRAWINGS

FIG. 1 is a schematic perspective view of the invention components. These are conveniently separated according to one possible constructive implementation.

FIG. 2 is a schematic plan view of the reinforcement strip which is part of the invention.

FIG. 3 is a schematic view of an original vertical spare sheet.

FIG. 4 is a schematic view of the new sheet obtained after the reinforcement strip is applied to the spare sheet.

In the above figures, the same characters make reference to the same or corresponding parts.

DETAILED DESCRIPTION OF THE INVENTION

FIG. 1 illustrates the reinforcement strip 1, at a distance from the original sheet 2, to which it is applied during this stage of the manufacturing process; the punched holes 3 are also visible.

FIG. 2 shows the reinforcement strip 1 in plan view, next to which FIG. 3 shows a conventional spare sheet 4 with lines.

FIG. 4 is the result of incorporating the strip 1 to the sheet 4, which results in the model sheet designated as 5.

Figure 6:
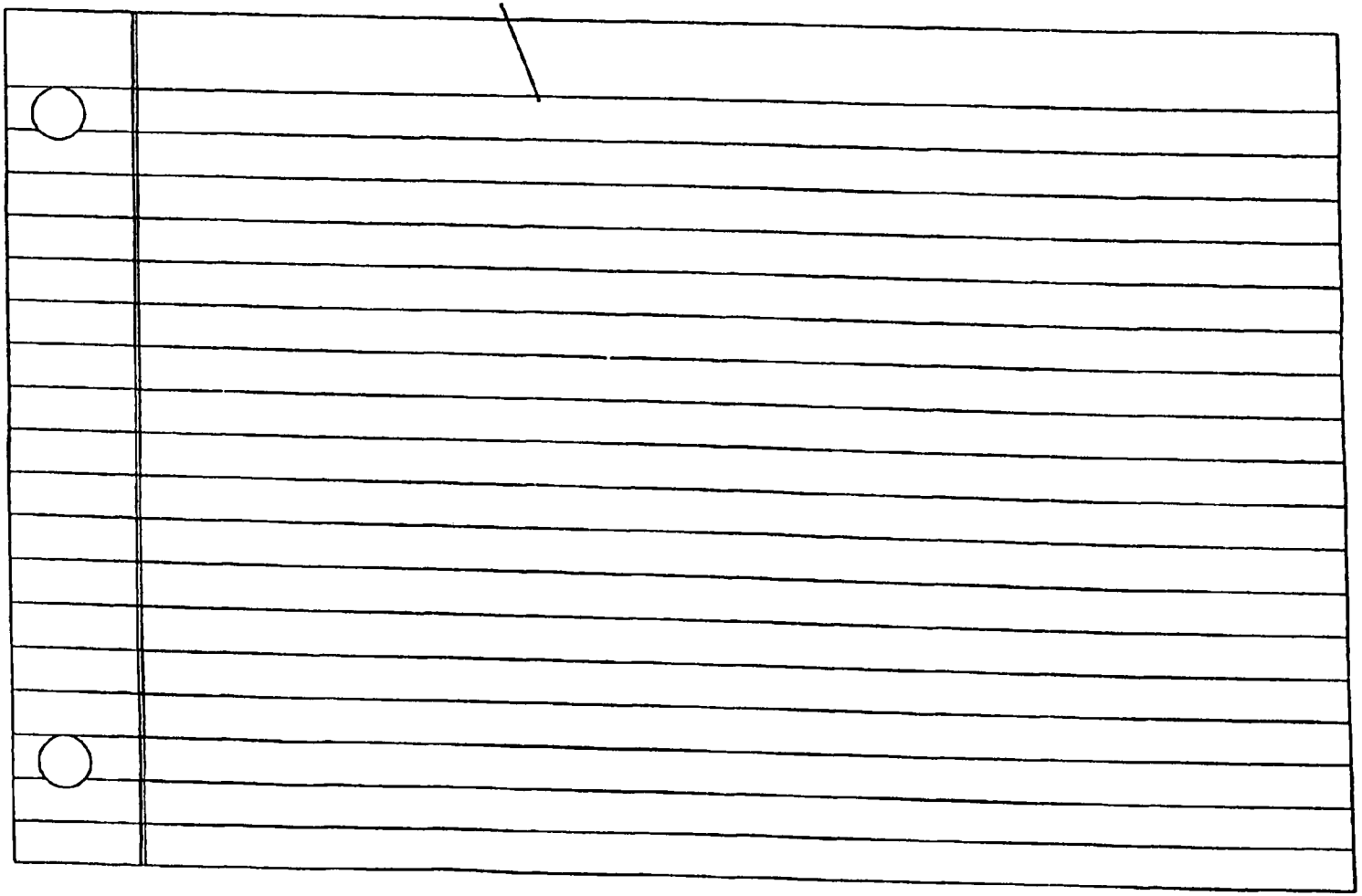
FIG. 6 shows the new oblong sheet obtained.
Figure 5:
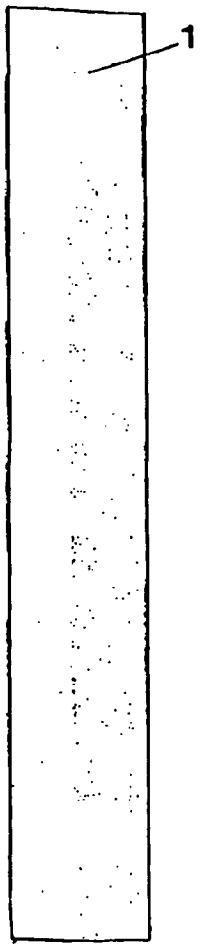
FIG. 5 is a schematic view of a variation of the reinforcement strip.

FIG. 5 shows the strip 1 ready for being stuck to the conventional oblong sheet 6 in FIG. 6.

Although the components appear in the drawings with their holes already punched, it must be noted that the strips may be applied without any holes so that these can be made at a later stage. The essence of the final invention is that the sheet has the strip stuck to it as illustrated by FIG. 4. A possible variation not illustrated here might consist of discontinuous plastic strip stretches located in coincidence with the required punched holes.

Figure 7:
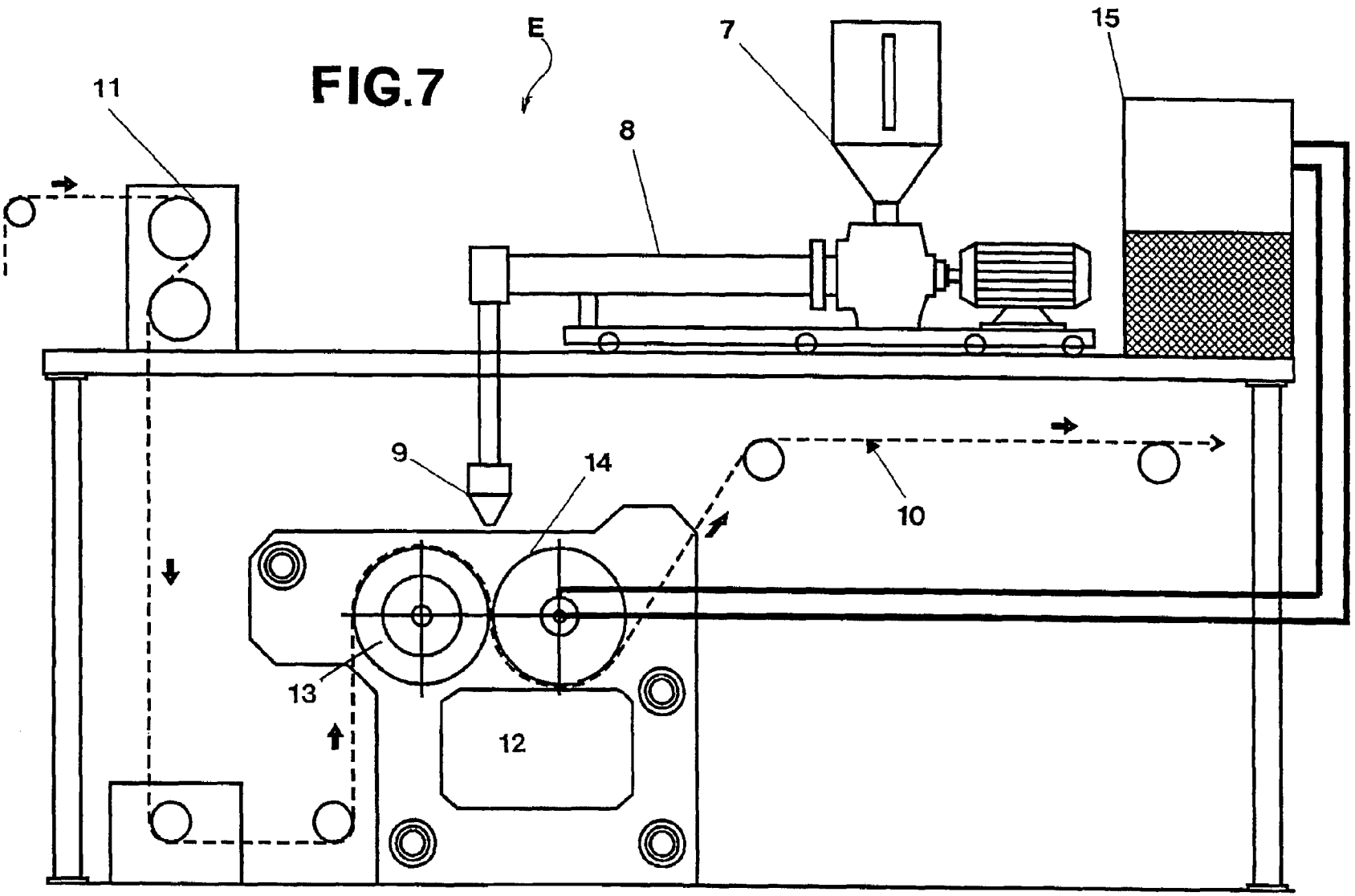
FIG. 7 is a schematic diagram of the apparatus E of the invention that is capable of applying a reinforcement strip to folder sheets.

FIG. 7 represents a schematic diagram of the apparatus E—an applicator of the reinforcement strip. It includes a gravimetric and pneumatic feeding system 7 with means of measuring the volume of extrusion which also allows to visualize the operation. The feeding system 7 feeds a thermoplastic material, such as polyethylene or similar type in granules or pellets, to an extrusion apparatus 8 of a lineal type, endless screw. The thermoplastic material that comes out melted is canalized through an applicator 9 with multiple exits according to the type and dimensions of the folder sheets being manufactured, and according to the bobbin which provides the paper band 10 to the production installation. In this embodiment, the applicator 9 may have between 3 and 5 exits.

The paper band 10 comes out of its bobbin or spindle, may reach a speed of 250 m/min, is circulated by the installation, and passes through a high tension, high frequency generator 11. The generator 11 produces the corona effect, and prepares the surfaces over which the melted thermoplastic material will be incorporated or applied. In other words, it will form the reinforcement strips 1 obtained by this process.

As shown in FIG. 7, the exits of the applicator 9 of the melted thermoplastic material are placed over the calender system 12, corresponding with the cylinder 13 which the paper band 10 being circulated passes. The paper band 10 passes continuously by the cooling cylinder 14, which consolidates the projections of the melted thermoplastic material deposited on the paper band 10.

The cylinder 14 is related to or in communicated with a cooling equipment 15 provided with its corresponding condenser by air.

Figure 8:
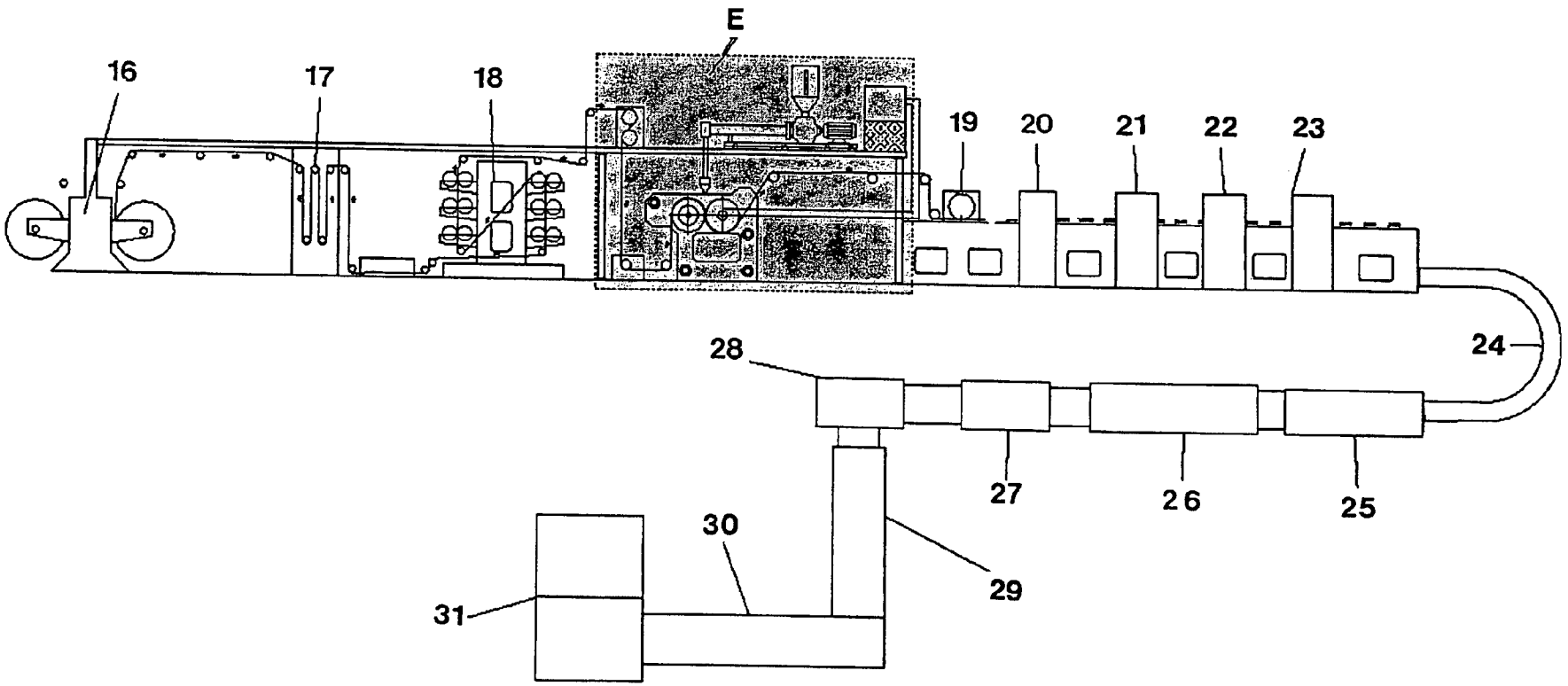
FIG. 8 is a general schematic diagram of one of the possible production installations, to which the apparatus of the invention in FIG. 7 has been incorporated.

FIG. 8 shows a conventional rotating printer, to which the apparatus of the present invention has been added. The printer is integrated with an unwinding unit 16, followed by a compensator 17 that eliminates possible misalignment of the paper band 10 when the paper band is fed to a printing unit 18. To the right or exit of the printing unit 18 is the apparatus of the present invention, which is designated generically with the letter E and is discussed in detail in FIG. 7. To the right or exit of the apparatus E is a rounded blade 19 for transversal cutting the paper band 10 into paper strips, followed by a counting and piling unit 20 for counting and piling the paper strips. The counted and piled paper strips are placed in area 21 where they pass to area 22 in which the punching of the paper strips takes place. The paper strips then pass to area 23 where the trimmer cut or longitudinal cut of the paper strips takes place to form a plurality of finished folder sheets.

In that place the machine presents a curve 24 that not only shortens the length of the rotating machine but also leaves a corridor for the operator who controls the functioning of the line of continuous production.

In area 25, the individual packing of the folder sheet blocks is made, using a thermo-shrinking thermoplastic material. This process is completed in the heating furnace 26.

These packed blocks are then moved to area 27 where they are accumulated in the desired amount. Then the accumulated blocks are packed with a thermo-shrinking packaging or wrap in area 28, then submitted to the heating furnace 29, and then transported by means of a transporting belt 30 to the final place 31 of the installation where the accumulated and packed blocks are packed away in boxes.

During this process, each block may be identified by adding a cover sheet indicating the data and origin of the folder sheets.

In order to obtain the described result, conventional paper sheets are used, either plain or with lines, and either bound or loose. Their weight may range from at least 50 grams/$m^2$ to 140 grams/$m^2$ in all formats including A6, A5, A4, A3 and even 320×470 mm. On one side of the sheet circular, oval or square holes are made, either lengthwise or crosswise, of a size comprised within 3 to 10 mm of diameter or side of the hole.

The protection or reinforcement strip 1 is incorporated by stretches or continuously as illustrated, during the manufacturing process of the folder sheets. By means of the extrusion apparatus 8 and through the exits of the applicator 9, a thin, resistant sheet element is deposited. The element can be either transparent or colored, consisting of a thermoplastic strip of a suitable material such as polyethylene or PVC or even polyamide, and has a thickness preferably between 15 and 50 microns, and a width preferably between 4 and 70 mm.

The thermoplastic material is applied in melted state at a controlled temperature of approximately 300° C. and is automatically applied to the paper. After this it is subject to fast cooling to ensure that it will stick to and partially penetrate the supporting paper.

The reinforcement strip 1, which may be applied to the reverse or opposite side of the paper, may also be presented in textured form or with images, information, symbols, etc. The final product will have all the characteristics of the "original base product" with the operational improvement provided by the incorporation of the above-mentioned strip during the manufacturing process.

Once the different components of the invention have been described above in order to explain their nature, the description will be completed below with reference to the functional and operational relationship between them and the results obtained.

Given the morphologic and constructive simplicity of the invention described above, it seems unnecessary to go into any further details. It is crystal clear that this new industrial product provides countless advantages as regards its operational performance from the viewpoint of user, without involving a noticeable increase in manufacturing costs.

The method of manufacturing the folder sheets with reinforce holes discussed above is a continuous and integrated process. It begins with the unwinding of the conventional spare paper and ends with the boxed final products.

The materials used in the manufacturing and packaging process include, but are not limited to, spindled paper band, thermoplastic material such as polyethylene pellets, dye such as aniline dye, plastic wrapping films and boxes.

The manufacturing process includes, but is not limited to, the following steps, some of which are known in the prior art:

1) Unwinding and Printing

In these steps, the spindled paper band is unwound from the cylinder and placed in a printer. The printer, after receiving the unwound paper band, applies a continual flexographic print with aniline dye according to a predetermined specification or design.

The printer has various dye units that permit two-sided printing and several-color printing in a single run. It is combined with a compensator, the purpose of which is to eliminate and prevent possible misalignments of the paper band during its unwinding from the bobbin.

2) Treating the paper band through a high tension, high frequency generator with an intense electric lamp or zone that creates the corona effect that is applied to the paper band, preparing the areas of the paper band that will receive the reinforcement strip.

3) Coating

In this step, at least one narrow reinforcement strip of thermoplastic material in melted state is applied to or created in selected areas of the paper band that, when finished, will be perforated or punched. In this particular embodiment, the reinforcement strip is a polyethylene film having a thickness of approximately 30 microns and a width of approximately 20 mm, but as discussed earlier, polyvinyl chloride or polyamide film of various size and thickness may be used.

The application is an extrusion process involving fusion of thermoplastic material such as polyethylene pellets that heat up during a run through an endless screw, which once melted are applied over the paper band with a specially designed tube in a calendered system of refrigerated cylinder. One of the cylinders will ensure that the melted thermoplastic material will penetrate and integrate with the fibers and firmly stick itself to the paper band. The other cylinder will cool off the thermoplastic material after it is applied to the paper band.

4) Transversal Cutting

In this step, the printed and partially reinforced paper band is transversally cut (meaning cutting the paper band in a direction that is substantially perpendicular to the longitudinal edges or length of the paper band) through a circular blade in folds according to a predetermined format of the finished sheet. As should be understood, regardless whether the transversal cut is done subsequently (meaning one cut at a time) or simultaneously (meaning multiple cuts at a time), or in any other fashion, the cut is in such a fashion that it generates multiple paper strips each having an elongated reinforced edge area.

5) Page Counting

In this step, the paper strips are layered and counted until they reach a predetermined number and are placed in piles.

6) Perforation

In this step, the paper trips are perforated or punched in all their reinforced edge areas in accordance with a predetermined pattern. In other words, the punch is made in the areas where the reinforcement strip was applied earlier.

7) Longitudinal Cutting (Trimmer) and Piling

In this stage, the paper strips are cut in a direction that is substantially perpendicular to the direction of the first cutting in accordance with a predetermined format of the finished folder sheets. Regardless whether the longitudinal cut is done subsequently (meaning one cut at a time) or simultaneously (meaning multiple cuts at a time), or in any other fashion, the end result is that multiple folder sheets are generated after the cutting. The folder sheets are then counted and piled to form a block until they reach a predetermined number or quality. A cover sheet with references and characteristics of the finished product may be included.

In the present invention, the width of the paper band would allow between three to six different sheet formats.

8) Packaging and Boxing

In these steps, each folder sheets block is packaged. More particularly, each block is placed in a distinguishing film or package over which a plastic material is heat-sealed or heat-wrapped to wrap it by the thermo-shrinking material in an appropriate furnace for final presentation. The wrapped folder sheet blocks are accumulated in bigger packages held by thermo-shrinking wraps in their corresponding furnace and are then packaged.

As should be understood, some of the steps need not to be performed in the order in which they discussed. For example, the longitudinal cutting may be done prior to the transversal cutting, and may vary according to the format of the sheet that is being elaborated. In addition, some of the steps may not be needed in some instances. Some have been associated since they are commonly used in the prior art.

The above has attempted to summarize one of the various constructive possibilities inherent in the invention, the manner in which it operates, one of many manufacturing methods and a preferred apparatus to accomplish it. It is understood, however, that various modifications and changes to the embodiments presented herein are possible without going beyond the scope of the invention defined in the attached claims.

The invention claimed is:

1. A method of manufacturing folder sheets with reinforced holes, comprising the steps of:

(a) causing a paper band to go through corona treatment to condition the surface of the band to receive hot-melted thermoplastic material;

(b) applying a reinforcement strip of hot-melted thermoplastic material to selected areas of the paper band to form a partially reinforced paper band;

(c) cutting the partially reinforced paper band in a predetermined direction to form a plurality of paper strips each having an elongated-reinforced edge area including the reinforcement strip of thermoplastic material;

(d) layering and counting the paper strips until they reach a predetermined number;

(e) punching holes in the paper strips in the reinforced edge area;

(f) cutting the punched paper strips in a direction substantially perpendicular to the predetermined direction to form a plurality of folder sheets; and (g) packaging the folder sheets.

2. The method of claim 1, wherein step (b) includes subsequently cooling the applied hot-melted thermoplastic material by pressing a cooling cylinder against it the thermoplastic material.

3. The method of claim 2, wherein the thermoplastic material is selected from the group consisting of polyethylene, polyvinyl chloride, and polyamide.

4. A method of manufacturing folder sheets with reinforced holes, comprising the steps of:

(a) unwinding a spindled paper band;

(b) causing the paper band to go through corona treatment to condition the surface of the band to receive hot-melted thermoplastic material;

(c) applying a reinforcement strip of hot-melted thermoplastic material to selected areas of the paper band to form a partially reinforced paper band;

(d) cutting the partially reinforced paper band in a first direction substantially perpendicular to one edge of the paper band to form a plurality of paper strips each having an elongated reinforced edge area including the reinforcement strip of thermoplastic material;

(e) layering and counting the paper strips until they reach a predetermined number;

(f) punching holes in the paper strips in the reinforced edge area in accordance with a predetermined pattern;

(g) cutting the punched paper strips in a direction substantially perpendicular to the first direction to form a plurality of folder sheets; and (h) packaging and boxing the folder sheets.

5. The method of claim 4, wherein step (c) includes subsequently cooling the applied hot-melted thermoplastic material by pressing a cooling cylinder against the thermoplastic material.

6. The method of claim 5, wherein the thermoplastic material is selected from the group consisting of polyethylene, polyvinyl chloride, and polyamide.

7. The method of claim 4, wherein the reinforcement strip has a thickness between 15 and 50 microns.

8. The method of claim 7, wherein the reinforcement strip has a thickness of about 30 microns.

9. The method of claim 4, wherein the reinforcement strip has a width between 4 and 70 mm.

10. The method of claim 9, wherein the reinforcement strip has a width of about 20 mm.

11. The method of claim 4, wherein the reinforcement strip is transparent.

12. The method of claim 4, wherein the reinforcement strip is colored.

13. A method of manufacturing folder sheets with reinforced holes, comprising the steps of:

(a) unwinding a spindled paper band;

(b) printing predetermined graphics on the unwound paper band;

(c) causing the unwound paper band to go through corona treatment to condition the surface of the band to receive hot-melted thermoplastic material;

(d) applying a reinforcement strip of hot-melted thermoplastic material to selected areas of the paper band to form a partially reinforced paper band;

(e) cutting the printed and partially reinforced paper band in a first direction substantially perpendicular to one edge of the paper band to form a plurality of paper strips each having an elongated reinforced edge area including the reinforcement strip of thermoplastic material;

(f) layering and counting the paper strips until they reach a predetermined number;

(g) punching holes in the paper strips in the reinforced edge area in accordance with a predetermined pattern;

(h) cutting the punched paper strips in a direction substantially perpendicular to the first direction to form a plurality of folder sheets;

(i) counting and piling the folder sheets to form a block until they reach a predetermined number; and (j) packaging and boxing the folder sheet blocks.

14. The method of claim 13, wherein step (d) includes subsequently cooling the applied hot-melted thermoplastic material by pressing a cooling cylinder against the thermoplastic material.

15. The method of claim 14, wherein the thermoplastic material is selected from the group consisting of polyethylene, polyvinyl chloride, and polyamide.

16. The method of claim 13, wherein the reinforcement strip has a thickness between 15 and 50 microns.

17. The method of claim 16, wherein the reinforcement strip has a thickness of about 30 microns.

18. The method of claim 13, wherein the reinforcement strip has a width between 4 and 70 mm.

19. The method of claim 18, wherein the reinforcement strip has a width of about 20 mm.

20. The method of claim 13, wherein step (j) includes packaging each folder sheet block with a thermo shrinking wrap, and then packaging packs of folder sheet blocks with a thermo shrinking wrap.

* * * * *

UNITED STATES PATENT AND TRADEMARK OFFICE

CERTIFICATE OF CORRECTION

PATENT NO. : 7,234,288 B2
APPLICATION NO. : 10/940412
DATED : June 26, 2007
INVENTOR(S) : Lebedevski et al.

It is certified that error appears in the above-identified patent and that said Letters Patent is hereby corrected as shown below:

Column 7, Line 18: Delete the word "it"

Signed and Sealed this

Sixth Day of November, 2007

JON W. DUDAS
*Director of the United States Patent and Trademark Office*